US005144097A

United States Patent [19]

Snyder, Sr.

[11] Patent Number: 5,144,097

[45] Date of Patent: Sep. 1, 1992

[54] CARRIER CLIP APPARATUS FOR LINEAR LINKLESS AMMUNITION SYSTEMS

[75] Inventor: Ronald R. Snyder, Sr., Irvine, Calif.

[73] Assignee: Western Design Corporation, Irvine, Calif.

[21] Appl. No.: 767,101

[22] Filed: Sep. 27, 1991

[51] Int. Cl.[5] ..... F42B 39/08

[52] U.S. Cl. ..... 89/35.1; 89/33.16; 89/33.17; 89/33.25

[58] Field of Search ..... 89/33.1, 33.14, 33.16, 89/33.17, 33.2, 33.25, 33.5, 35.1, 35.2

[56] References Cited

U.S. PATENT DOCUMENTS

| | | | |
|---|---|---|---|
| 2,401,654 | 6/1946 | Molins et al. | 89/33.1 |
| 4,263,837 | 4/1981 | Tassie | 89/34 |
| 4,392,414 | 7/1983 | Koine | 89/35.1 |
| 4,876.940 | 10/1989 | Aloi et al. | 89/33.16 |

FOREIGN PATENT DOCUMENTS

| | | | |
|---|---|---|---|
| 571771 | 3/1933 | Fed. Rep. of Germany | 89/35.1 |
| 629816 | 9/1949 | United Kingdom | 89/33.25 |

*Primary Examiner*—Stephen Johnson
*Attorney, Agent, or Firm*—Walter A. Hackler

[57] ABSTRACT

Carrier clip apparatus for use in linear linkless ammunition systems, including a cradle attached to a chain along with a plurality of legs, protruding from one side of the cradles, for guiding an ammunition round as the chain is moved in the linear linkless system and for enabling ammunition round transfer as the cradle and chain pass around a chain sprocket. Also provided is a retainer clip, attached to an opposite side of said cradle with a bendable edge portion extending to one side of the cradle in a spaced apart relationship with the legs, for releasably holding said ammunition round in the cradle and against said leg means.

19 Claims, 3 Drawing Sheets

CARRIER CLIP APPARATUS FOR LINEAR LINKLESS AMMUNITION SYSTEMS

The present invention relates generally to ammunition storage systems and more particularly to linear linkless ammunition systems.

Linear linkless ammunition systems have been developed for modern automatic weapons which require storage of a great deal of ammunition to support the very high firing rates of weaponry.

It should be obvious that in order to utilize the fire power of modern weapons, ammunition rounds must be available to the gun in a reliable fashion, which corresponds to the gun firing rate. In the event that this does not occur, gun timing may be disrupted and possibly cause gun malfunction.

In order to reduce the overall weight of the ammunition magazine and the weight of the stored ammunition which must be moved through the magazine as the gun fires, linear linkless ammunition systems have been developed. These systems eliminate the conventional clip for holding ammunition rounds and links joining the ammunition clips for enabling the ammunition rounds to be moved in concert through an ammunition magazine in a conveyor-like fashion.

Because the linear linkless ammunition system eliminates the need for clips and links, a lighter weight system for ammunition transport, and therefore, lower power requirements are necessary for the movement of ammunition within the magazine and to the gun.

Typically, linear linkless ammunition storage systems utilize an endless chain ladder for enabling rolling engagement of the ammunition rounds with guides disposed on partitions of the ammunition magazine While this feature substantially reduces the frictional engagement of the ammunition rounds with internal surfaces of the magazine, substantial friction, and hence load on the driving system, remains an important consideration. These problems are particularly acute for triangular rounds of ammunition (TROUNDS).

The carrier clip apparatus of the present invention substantially improves the functioning of linear linkless ammunition systems by eliminating parts such as crossbars heretofore required, thereby providing for greater ease of manufacture, system simplicity, and lower cost.

Further, because of the absence of crossbars, stripper guides may be utilized and placed to the root of the round path which results in more positive and smoother round control.

In addition, center round control panels required in conventional linear linkless ammunition systems are eliminated as well as providing significantly reduced friction in turning areas of the round which further reduces power requirements.

SUMMARY OF THE INVENTION

In accordance with the present invention, carrier clip apparatus for use in linear linkless ammunition systems generally includes a cradle including means for enabling the cradle to be attached to a chain along with a plurality of leg means, protruding from one side of the cradle, for guiding an ammunition round as the chain is moved in the linear linkless system and for enabling ammunition round transfer as the cradle and chain pass around a chain sprocket.

In combination therewith, retainer clip means are provided, attached to an opposite side of the cradle, for releasably holding the ammunition round to the cradle and against the leg means. The retainer clips means includes a bendable edge portion extending to said one side of the cradle in a spaced apart relationship with the leg means.

Because the rounds are captured in the carrier clip, there is no need for additional guide surfaces for the ammunition rounds as they are moved through the linear linkless ammunition system by the chain. Thus, high friction turns are eliminated as well as any requirement for center round control panels because engagement therewith is not required in order to guide the ammunition rounds through an ammunition magazine.

More particularly, stripper means may be provided and attached to a chain sprocket for depressing the retainer clip means in order to release the ammunition round from the cradle, thereby enabling transfer of the ammunition round from the cradle to a pin sprocket. To ensure that the retainer clip means is not inadvertently depressed, retainer guide means may be provided for preventing unwanted movement of the retainer clip and release of the ammunition round from the cradle.

The retainer guide means may be disposed adjacent to the chain sprocket in a position for preventing depression of the retainer clip means as the cradle passes around the chain sprocket.

Still more particularly, the cradle means may include first and second cradles, each attached to spaced apart chains in positions opposite to one another for holding an ammunition round therebetween. In one embodiment of the invention, the first and second cradles include means defining leg spacing for enabling the first cradle to hold a casing end of an ammunition round and a second cradle to hold a projectile end of an ammunition round.

In another embodiment of the present invention, first and second cradles may include means defining leg spacing for enabling the first and second cradles to hold either end of a caseless ammunition round, with the latter having either a triangular cross-section, or a circular cross-section.

BRIEF DESCRIPTION OF THE DRAWINGS

The advantages and features of the present invention will appear from the following description when considered in conjunction with the accompanying drawings in which.

DETAILED DESCRIPTION

Figure 1:
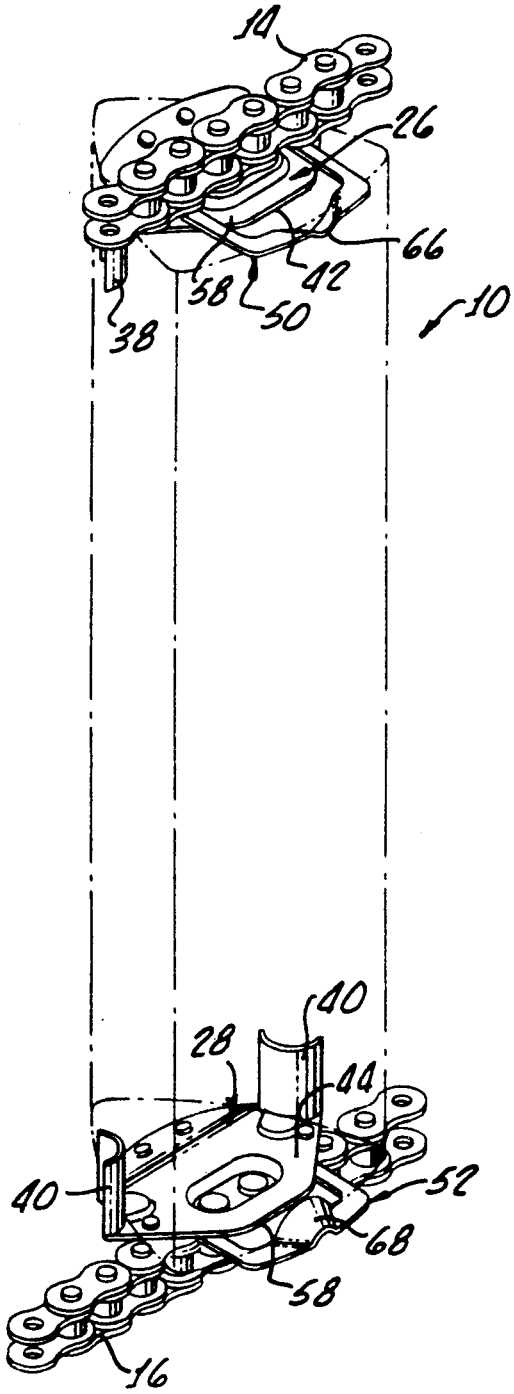
FIG. 1 is a perspective view of the apparatus in accordance with the present invention generally showing two cradles attached to spaced apart chains for holding and driving an ammunition TROUND.
Figure 2:
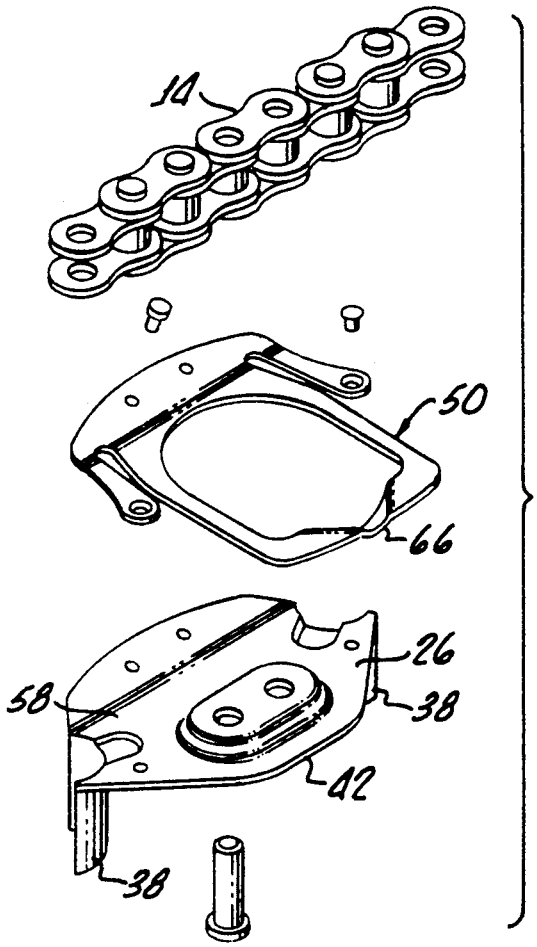
FIG. 2 is an exploded view of the cradle, retainer clip and chain in accordance with the present invention.
Figure 3:
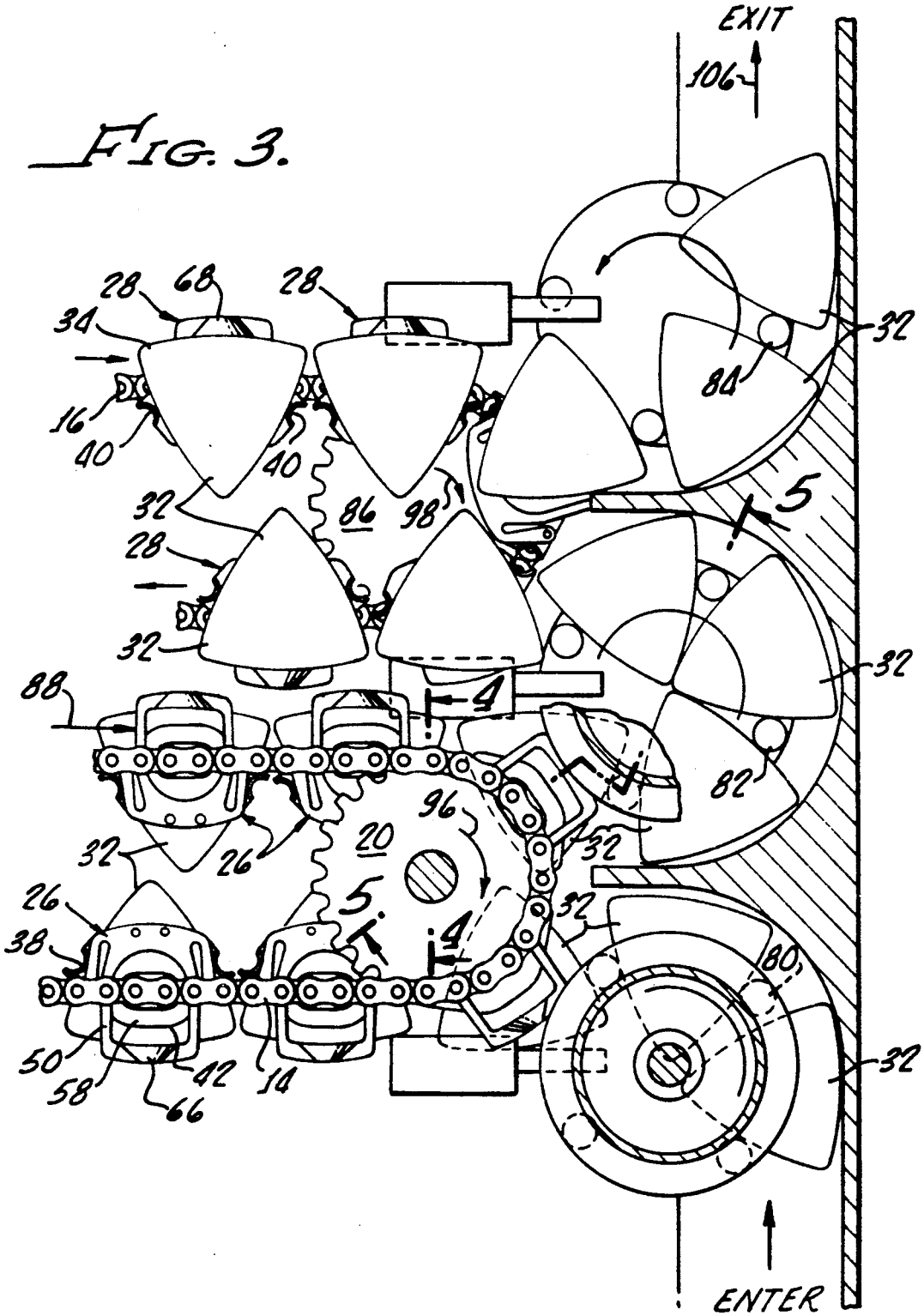
FIG. 3 is a cross-sectional view of a portion of a linear linkless ammunition system showing combination pin and chain sprockets for handing off ammunition.

Turning now to FIG. 1-3, there is generally shown ammunition carrier apparatus 10 which generally includes a pair of chains 14, 16 and chain sprockets 20 (FIG. 3), which provide a means for supporting and driving the pair of chains 14, 16 in a spaced apart relationship. First and second cradles 26, 28 attached respectively to the chains 14, 16 provide means for holding a TROUND 32 or round 34 (See FIG. 4) between the spaced apart sprocket driven chains 14, 16 and enable passage of an ammunition round or TROUND through a linear linkless ammunition system (not shown) without separate guide surfaces for controlling the ammunition round, or TROUND, movement through the linear linkless ammunition system. In the Figures, only one sprocket 20 is shown in conjunction with cradle 26 for simplicity of presentation. It should be appreciated that each of the cradles 26, 28 have associated identical chain sprockets. In addition, detailed description and drawing of an exemplary linear linkless ammunition system are not necessary to explain the operation of the present invention since the apparatus 10 is capable of holding and supporting the ammunition round 34 or TROUND 32 independently and separately from any guiding surface (not shown) or partition (not shown) of a conventional linear linkless ammunition system.

The cradles 26, 28 may be formed or shaped from any suitable material and include legs 38, 40, protruding from one side 42, 44, respectively, of cradles 26, 28.

The legs 38, 40 provide means for guiding the ammunition round 34 or TROUND 32 as the chains 14, 16 are moved through the linear linkless ammunition system (not shown).

In combination with the cradles 26, 28, retainer clips 50, 52, attached to opposite sides 58, 60 of cradles 26, 28, provide means for releasably holding the ammunition round 34 or TROUND 32 to the cradles 26, 28, and against the legs 38, 40, respectively.

Further, as hereinafter described in greater detail, each retainer clip 50, 52 includes a bendable edge portion 66, 68, which extends to the sides 42, 44 of the cradles 26, 28, respectively, and in a spaced apart relationship with the legs 38, 40, respectively, thereby providing a three-point relationship for releasably holding the ammunition round 34 or TROUND 32 to the cradles 26, 28, respectively.

Figure 4:
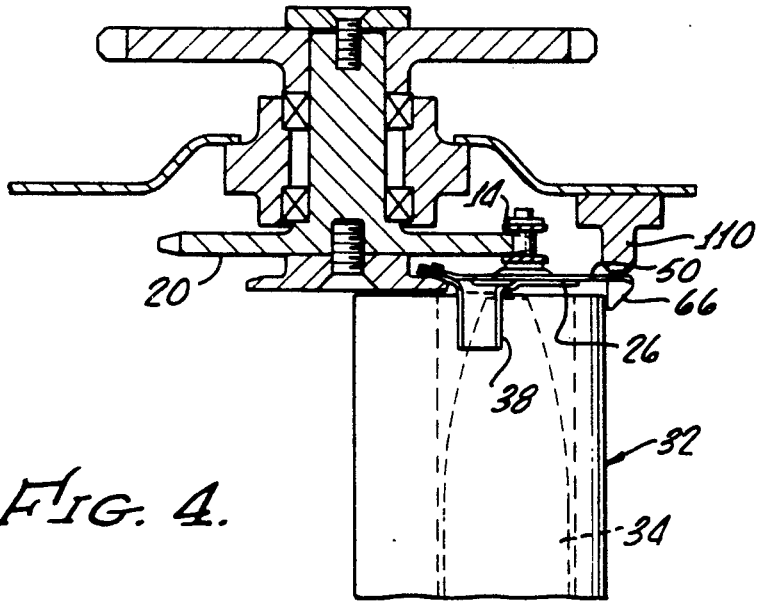
FIG. 4 is a cross-sectional view, taken along the line 4—4 of FIG. 3, showing a cradle in conjunction with a chain sprocket and a retainer clip preventing premature release of a round from the cradle.

When the bendable portions, or tabs, 66, 68 are in positions as shown in FIGS. 1 and 4, the ammunition round 34 or TROUND 32 is securely held in and between the cradles 26, 28. This secure positioning eliminates the need for crossbars (not shown) or guide surfaces (not shown) required in prior art linear linkless systems. Consequently, no matter what the circuitous path the chains 14, 16 may follow through a linear linkless system, no further support or guide system is required for ensuring coordinated movement of the round 34 or TROUND 32 than that provided by the cradles 26, 28.

As shown in FIG. 4, spacing 100 between legs 38 on cradle 26 may enable the cradle 26 to hold a projectile end 72 of ammunition round 34.

Alternatively, equal spacing between the legs 38, 40 on cradles 26, 28 may be provided to enable the first and second cradles 26, 28 to hold either end of a caseless ammunition round (not shown) or TROUND 32.

Figure 5:
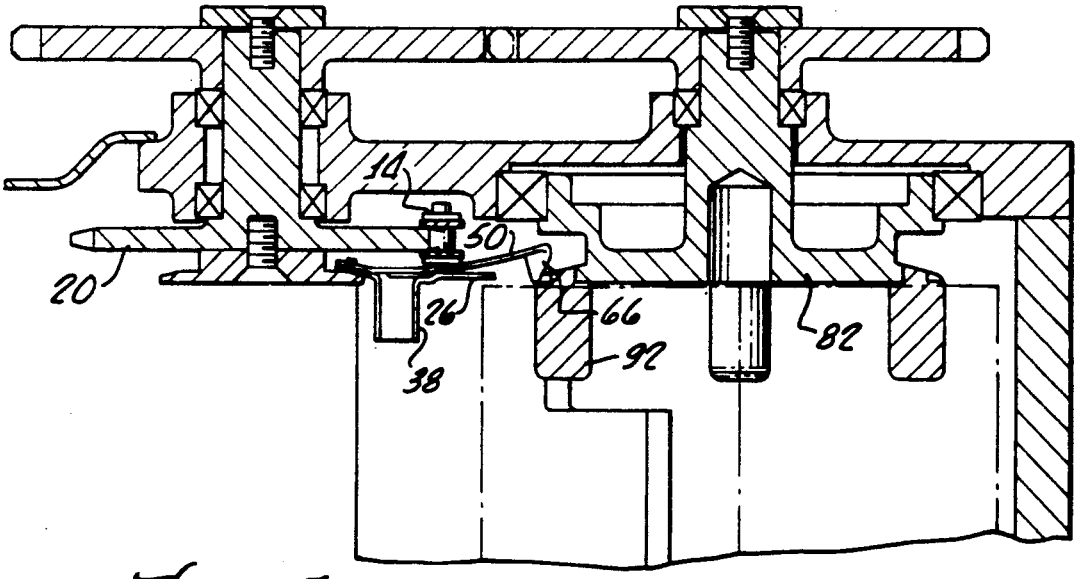
FIG. 5 is a cross-sectional view, taken along the line 5—5 of FIG. 3, of a cradle in accordance with the present invention showing the retainer clip depressed in order for rounds or TROUNDs to be transferred to a pin sprocket.

Operation of the apparatus 10 in accordance with the present invention is shown in FIG. 3 wherein pin sprockets 80, 82, 84 and chain sprockets 20, 86 are arranged for handling and removing ammunition TROUNDS 32 from cradle 26. As shown, movement of the chain 14 in the direction of arrow 88 towards the pin sprocket 80 occurs by rotation of the chain sprocket 20 in a clockwise direction as indicated by arrow 96. The tab 66 is depressed by strippers 92 (see FIG. 5) enabling the passing of the TROUND 32 on to the pin sprocket 82. As the chain sprocket 86 rotates in a clockwise direction as shown by the arrow 98, the cradle 26 guides other TROUNDs 32 with the retainer clip 50 being depressed so that the TROUND 32 may be handed off to the pin sprocket 84 where it exits in the direction of arrow 106.

An empty cradle 100 continues to revolve around the chain sprocket 86 and it is filled with another TROUND 32 from the pin sprocket 82, as shown. It should be appreciated that while only a limited number of pin sprockets and chain sprockets are shown in the figure, any number may be utilized throughout a linear linkless ammunition system for both moving ammunition rounds 34 or TROUNDs 32 from the cradles 26, 28.

As discussed in connection with FIG. 3, in order to remove the ammunition round 34 or TROUND 32 from the cradles 26, 28, respectively, strippers 92 may be attached to pin sprockets 80, 82, 84 (See FIG. 5) which provide a means for depressing the retainer clips 50, 52 by engagement with the tabs 66, 68 to a point beyond the sides 42, 44 of the cradles 26, 28 in order to release the ammunition round 32 or TROUND 34 from the cradles 26, 28 and enable transfer of the ammunition round 32 or TROUND 34 from the cradles 26, 28 to the pin sprockets 82, 84.

To ensure that inadvertent release of the ammunition round 32 or TROUND 34 from the cradles 26, 28 does not occur, retainer guides 110 may be provided and disposed adjacent to chain sprockets 20, as illustrated in FIG. 4.

Although there has been hereinabove described a carrier clip apparatus for use in linear linkless ammunition systems in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the present invention as defined in the appended claims.

What is claimed is:

1. Carrier clip apparatus for use in linear linkless ammunition systems, said carrier clip apparatus comprising:

a cradle including means for attaching the cradle to a chain and a plurality of leg means, protruding from one side of the cradle, for guiding an ammunition round as the chain is moved in the linear linkless system and for enabling ammunition round transfer as the cradle and chain pass around a chain sprocket;

retainer clip means, attached to an opposite side of said cradle, for releasably holding said ammunition round to the cradle and against said leg means, said retainer clip means comprising a bendable edge portion extending to said one side of the cradle in a spaced apart relationship with said leg means;

stripper means, attached to a pin sprocket, for depressing said retainer clip means in order to release the ammunition round from said cradle and enable transfer of the ammunition round from the cradle to the pin sprocket;

retainer guide means for preventing inadvertent release of the ammunition from said cradle, said retainer guide means being adjacent to a chain sprocket in a position preventing depression of said retainer clip means as the cradle passes around the chain sprocket.

2. Carrier clip apparatus for use in linear linkless ammunition systems, said carrier clip apparatus comprising:

cradle means for holding an ammunition round between two spaced apart sprocket driven chains and enabling passage of the ammunition round through the linear linkless ammunition system without separate guide surfaces for contacting the ammunition round to control round movement through the linear linkless ammunition system, said cradle means including means for attaching the cradle means to the chains and leg means, protruding from one side of the cradle means, for guiding the ammunition round as the chain is moved through the linear linkless ammunition system; and retainer chip means, attached to an opposite side of said cradle means, for releasably holding said ammunition round to the cradle and against said leg means, said retainer clip means comprising a bendable edge portion extending to said one side of the cradle in a spaced apart relationship with said leg means.

3. The carrier clip apparatus according to claim 2 further comprising stripper means, attached to a pin sprocket, for depressing said retainer clip means in order to release the ammunition round from said cradle means and enable transfer of the ammunition round from the cradle means to the pin sprocket.

4. The carrier clip apparatus according to claim 3 further comprising retainer guide means for preventing inadvertent release of the ammunition from said cradle means.

5. The carrier clip apparatus according to claim 4 wherein said retainer guide means is adjacent to a chain sprocket in a position preventing depression of said retainer clip means as the cradle means passes around the chain sprocket.

6. The carrier clip apparatus according to claim 2 wherein said cradle means comprises a first and a second cradle, each attached to the spaced apart chains at positions opposite one another for holding the ammunition round therebetween.

7. The carrier clip apparatus according to claim 6 wherein the leg means of said first and second cradles include spaced apart legs, the leg spacing enabling the first cradle to hold a casing end of the ammunition round and the second cradle to hold a projectile end of the ammunition round.

8. The carrier clip apparatus according to claim 6 wherein the leg means of said first and second cradles include spaced apart legs, the leg spacing enabling the first and second cradles to hold either end of a caseless ammunition round.

9. The carrier clip apparatus according to claim 8 wherein said caseless ammunition round has a triangular cross-section.

10. The carrier clip apparatus according to claim 8 wherein said caseless ammunition round has a circular cross-section.

11. Ammunition carrier apparatus for use in linear linkless ammunition systems, said carrier apparatus comprising:

a pair of chains;

chain sprocket means for supporting and driving said pair of chains in a spaced apart relationship;

cradle means for holding an ammunition round between two spaced apart sprocket driven chains and enabling passage of the ammunition round through the linear linkless ammunition system without separate guide surfaces for contacting the ammunition round to control round movement through the linear linkless ammunition system, said cradle means including means for attaching the cradle means to the chains and leg means, protruding from one side of the cradle means, for guiding the ammunition round as the chain is moved through the linear linkless ammunition system; and retainer clip means, attached to an opposite side of said cradle means, for releasably holding said ammunition round to the cradle means and against said leg means, said retainer clip means comprising a bendable edge portion extending to said one side of the cradle in a spaced apart relationship with said leg means.

12. The carrier clip apparatus according to claim 11 further comprising stripper means, attached to a pin sprocket, for depressing said retainer clip means in order to release the ammunition round from said cradle means and enable transfer of the ammunition round from the cradle means to the pin sprocket.

13. The carrier clip apparatus according to claim 12 further comprising retainer guide means for preventing inadvertent release of the ammunition from said cradle means.

14. The carrier clip apparatus according to claim 13 wherein said retainer guide means is adjacent to the chain sprocket in a position preventing depression of said retainer clip means as the cradle passes around the chain sprocket means.

15. The carrier clip apparatus according to claim 11 wherein said cradle means comprises a first and a second cradle, each attached to the spaced apart chains at positions opposite one another for holding the ammunition round therebetween.

16. The carrier clip apparatus according to claim 15 wherein the leg means of said first and second cradles include spaced apart legs, the leg spacing enabling the first cradle to hold a casing end of the ammunition round and the second cradle to hold a projectile end of the ammunition round.

17. The carrier clip apparatus according to claim 15 wherein the leg means of said first and second cradles include spaced apart legs, the leg spacing enabling the first and second cradles to hold either end of a caseless ammunition round.

18. The carrier clip apparatus according to claim 17 wherein said caseless ammunition round has a triangular cross-section.

19. The carrier clip apparatus according to claim 17 wherein said caseless ammunition round has a circular cross-section.

* * * * *